US008111207B2

(12) United States Patent
Liang et al.

(10) Patent No.: US 8,111,207 B2
(45) Date of Patent: Feb. 7, 2012

(54) ANTENNA STRUCTURE AND RELATED EXPANSION CARD AND COMPUTER APPARATUS

(75) Inventors: Te-Yu Liang, Taipei Hsien (TW); Hui-Jen Tseng, Taipei Hsien (TW); Wen-Chin Wu, Taipei Hsien (TW); Kuo-Kun Lin, Taipei Hsien (TW); Chu-Chia Tsai, Taipei Hsien (TW); Chia-Hsien Li, Taipei Hsien (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 92 days.

(21) Appl. No.: 11/877,674

(22) Filed: Oct. 24, 2007

(65) Prior Publication Data

US 2009/0051621 A1 Feb. 26, 2009

(30) Foreign Application Priority Data

Aug. 22, 2007 (TW) ..... 96131087 A

(51) Int. Cl.
*H01Q 1/50* (2006.01)

(52) U.S. Cl. ..... 343/906; 343/702; 343/720; 343/795; 343/846; 343/872

(58) Field of Classification Search ..... 343/700 MS, 343/702, 718, 767, 906, 878, 880, 893, 797, 343/720, 795, 846, 872
See application file for complete search history.

(56) References Cited

U.S. PATENT DOCUMENTS 5,572,401 A * 11/1996 Carroll ..... 361/679.03
5,918,163 A * 6/1999 Rossi ..... 455/558
6,190,182 B1 * 2/2001 Liebenow et al. ..... 439/74
6,348,893 B1 * 2/2002 Herranen et al. ..... 343/702
6,538,606 B2 * 3/2003 Quinn et al. ..... 343/702
6,570,538 B2 * 5/2003 Vaisanen et al. ..... 343/702
6,570,767 B1 * 5/2003 Vapaakoski et al. ..... 361/737
6,594,506 B1 * 7/2003 Vapaakoski et al. ..... 455/557
6,752,320 B1 * 6/2004 Herranen ..... 235/492
6,891,719 B2 * 5/2005 Lin et al. ..... 361/679.4
6,985,354 B2 * 1/2006 Yang et al. ..... 361/679.31
7,043,269 B2 * 5/2006 Ono et al. ..... 455/558
7,171,503 B2 * 1/2007 Lee et al. ..... 710/300
7,382,625 B2 * 6/2008 Thornton et al. ..... 361/737
7,488,214 B2 * 2/2009 Tanaka et al. ..... 439/630
7,601,031 B2 * 10/2009 Tanaka et al. ..... 439/626
2002/0034966 A1 * 3/2002 Saito et al. ..... 455/558
2006/0094466 A1 * 5/2006 Tran ..... 455/558
2008/0100746 A1 * 5/2008 Mukaiyama ..... 348/552
2008/0171473 A1 * 7/2008 Tanaka et al. ..... 439/626

OTHER PUBLICATIONS

Office action mailed on Aug. 3, 2011 for the China application No. 200710146293.4, p. 3 line 5~11 and line 22~28 and p. 4 line 13~20.

* cited by examiner

*Primary Examiner* — Douglas W Owens
*Assistant Examiner* — Chuc Tran
(74) *Attorney, Agent, or Firm* — Winston Hsu; Scott Margo

(57) ABSTRACT

An antenna structure includes an expansion card connector, an antenna, and a plurality of metal pins. The antenna is disposed on the expansion card connector. The plurality of metal pins is disposed on the expansion card connector, whereof the plurality of metal pins includes a first designated pin to be a feeding point of the antenna. The plurality of metal pins further includes a plurality of second designated pins, whereof the plurality of second designated pins is electrically connected to each other to be a radiator of the antenna.

18 Claims, 7 Drawing Sheets

ANTENNA STRUCTURE AND RELATED EXPANSION CARD AND COMPUTER APPARATUS

BACKGROUND OF THE INVENTION

1. Field of the Invention

The present invention relates to an antenna structure combined with an expansion card connector and related expansion card and computer apparatus, and more particularly, to an antenna structure disposing an antenna on the expansion card connector and related expansion card and computer apparatus.

2. Description of the Prior Art

Notebook computers are now commonly used for personal computing. Because they are small and light, notebook computers are suitable to be taken out of the home or office for document processing. Because wireless transmission techniques are maturing, hard-wired connections with electric network lines are no longer needed to transmit electrical signals, and signals may be received or transmitted from anywhere in a wireless manner.

However, the space in a notebook computer is limited, so it is very difficult or impossible to include all possible functions into a small notebook computer. Therefore, an expansion mechanism such as an Express Card, a PCMCIA card, or a PC card is needed to provide the new generation of mobile or desktop host computer more functionality. Regardless of demand for wired/wireless communications, multimedia, data security, data transmission, or memory cards, the problem of insufficient and excluded functions can be solved through an expansion card.

As wireless transmission techniques develop, antenna design becomes more important. If an antenna structure is desired to be disposed on the expansion card, the wrong location of the antenna or other reasons may result in poor performance due to the very small size of the expansion card. Therefore, rather unfortunately, the antenna is unable to demonstrate its actual efficiency.

SUMMARY OF THE INVENTION

It is one of the objectives of the claimed invention to provide an antenna structure and related expansion card and computer apparatus to solve the abovementioned problems.

The present invention discloses an antenna structure. The antenna structure includes an expansion card connector, an antenna, and a plurality of metal pins. The antenna is disposed on the expansion card connector. The plurality of metal pins is disposed on the expansion card connector and has a first designated pin to be a feeding point of the antenna.

In one embodiment, the plurality of metal pins includes a plurality of second designated pins, and the plurality of second designated pins is electrically connected to each other to be a radiator of the antenna.

In one embodiment, the antenna structure further includes a circuit board, wherein a side of the circuit board includes a protruding section, and at least one part of a radiator of the antenna is disposed on the protruding section.

In one embodiment, the expansion card connector includes a containing space and the containing space has a first plane parallel to a second plane. The plurality of metal pins is disposed in parallel on the first plane, and a radiator of the antenna is disposed on the second plane.

In one embodiment, the expansion card connector further includes an idiot-proof device being disposed on a surface of the expansion card connector, and a radiator of the antenna disposed on the idiot-proof device.

The present invention further discloses an expansion card. The expansion card includes an expansion card connector, a circuit board, an antenna, and a plurality of metal pins. The antenna is disposed on the expansion card connector and electrically connected to the circuit board. The plurality of metal pins is disposed on the expansion card connector and has a first designated pin to be a feeding point of the antenna.

In one embodiment, the expansion card is an Express card, a PCMCIA card, or a PC card.

The present invention further discloses a computer apparatus. The computer apparatus includes an expansion card slot and an expansion card. The expansion card includes an expansion card connector, a circuit board, an antenna, and a plurality of metal pins. The expansion card connector is used for connecting to the expansion card slot in a plug-and-play manner. The antenna is disposed on the expansion card connector and electrically connected to the circuit board. The plurality of metal pins is disposed on the expansion card connector and has a first designated pin to be a feeding point of the antenna.

In one embodiment, the expansion card is an Express card, a PCMCIA card, or a PC card.

In one embodiment, the computer apparatus is a notebook computer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
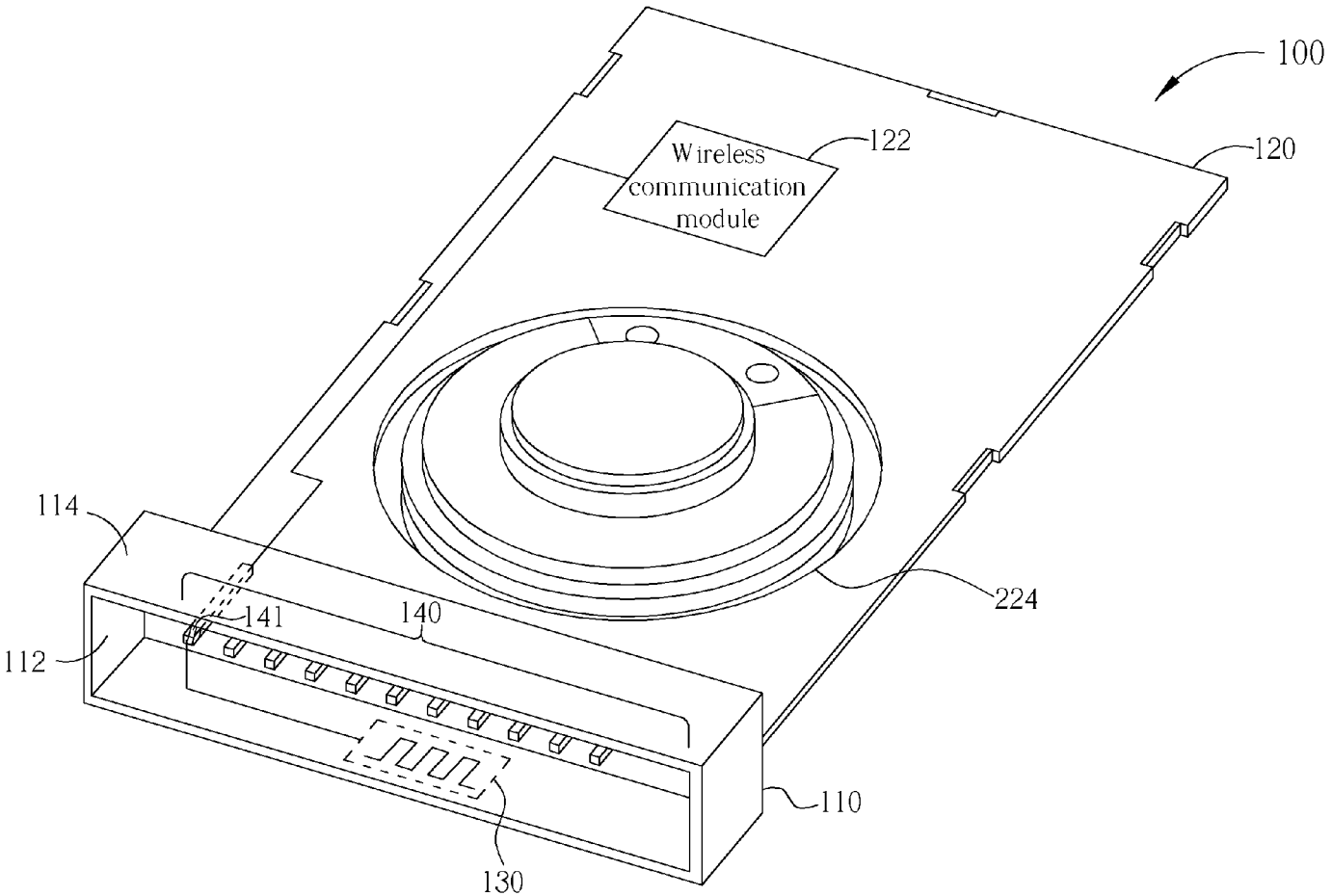
FIG. 1 is a diagram of an expansion card according to an embodiment of the present invention.

Please refer to FIG. 1. FIG. 1 is a diagram of an expansion card 100 according to an embodiment of the present invention. The expansion card 100 includes, but is not limited to, an expansion card connector 110, a circuit board 120, an antenna 130, a plurality of metal pins 140, and a peripheral device 224. The peripheral device 224 can be a loudspeaker or a microphone, as shown in FIG. 1, but is not limited to these embodiments. The expansion card connector 110 is a hollow cuboid and has a containing space 112. The expansion card connector 110 is composed of plastic material. The plurality of metal pins 140 is disposed on a first plane 114 of the expansion card connector 110 in parallel, and has a first designated pin 141 to be a feeding point of the antenna 130. The antenna 130 is disposed on the expansion card connector 110 and electrically connects to a wireless communication module 122 of the circuit board 120 through the first designated pin 141. The location of the antenna 130 will be explained in detail in the following embodiments.

Figure 2:
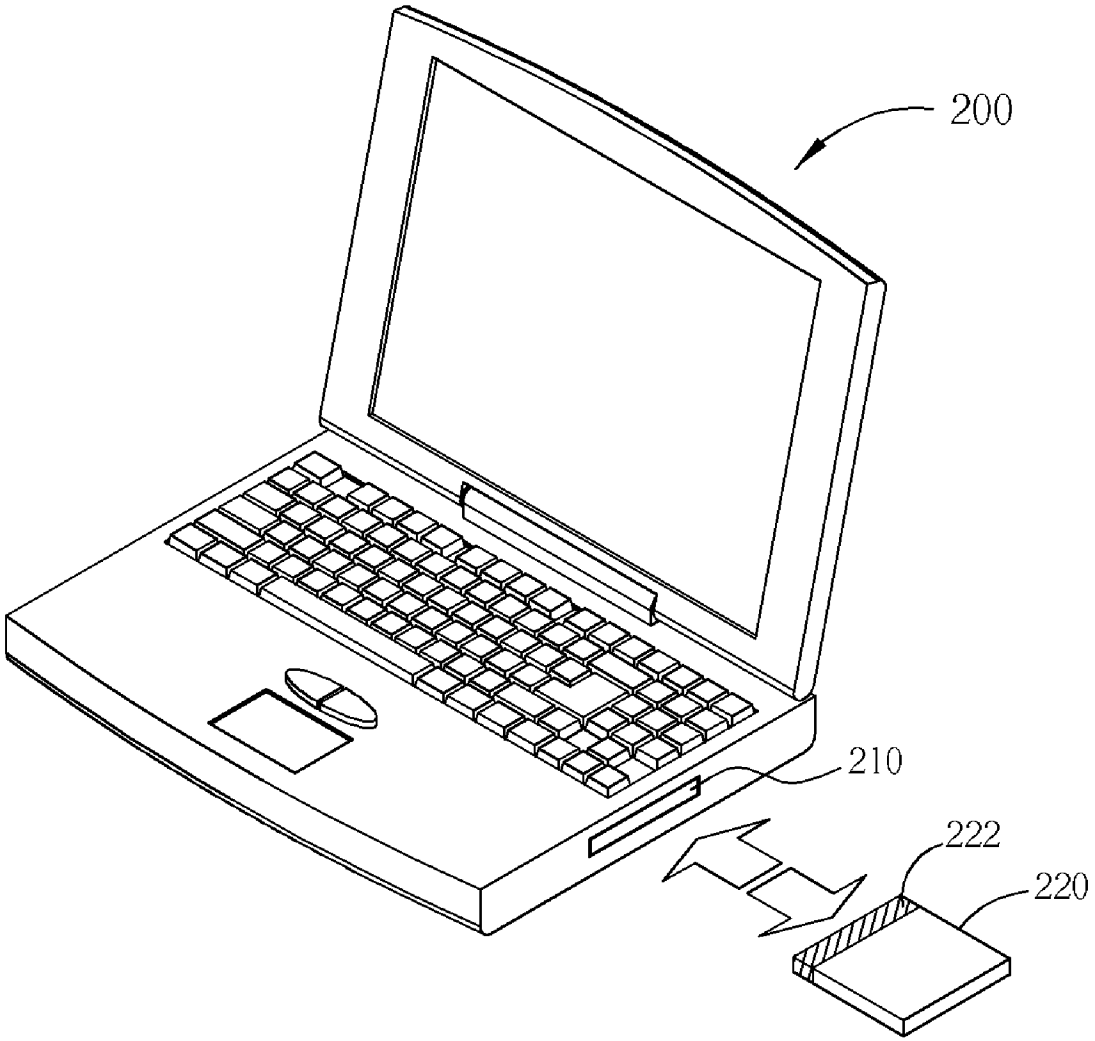
FIG. 2 is a diagram of a computer apparatus according to an embodiment of the present invention.

Please refer to FIG. 2. FIG. 2 is a diagram of a computer apparatus 200 according to an embodiment of the present invention. The computer apparatus 200 includes an expansion card slot 210 and an expansion card 220. The expansion card 220 includes an expansion card connector 222 for connecting to the expansion card slot 210 in a plug-and-play manner. In this embodiment, the expansion card 220 can be implemented by the expansion card 100 shown in FIG. 1. The expansion card 100 or 220 can be an Express card, a PCMCIA card, or a PC card, but is not limited to those and can be expansion cards of other types. When the expansion card connector 222 of the expansion card 220 is inserted into the expansion card slot 210 of the computer apparatus 200, the expansion card 220 can electrically connects to the computer apparatus 200 to let the computer apparatus 200 charge a battery (not shown in FIG. 2) of the expansion card 220. When the expansion card 220 is pulled out from the expansion card slot 210, the battery of the expansion card 220 can provide needed operation power to the wireless communication module (such as the wireless communication module 122 in FIG. 1) to communicate with the computer apparatus 200 wirelessly. For example, the expansion card 220 can be a VoIP phone, and the wireless communication module 122 can be a Bluetooth module. At this time, the expansion card 220 further includes common peripheral devices (not shown in FIG. 2) of a general mobile device, such as a loudspeaker or a microphone, to be used for sounds. Please note that, the abovementioned computer apparatus 200 is not limited to desktop personal computers (PC), and can be notebook PCs. Hence, the computer apparatus 200 includes other computer components except the expansion card slot 210 and expansion card 220. Those skilled in the art know that this is not a limitation of the present invention.

Figure 3:
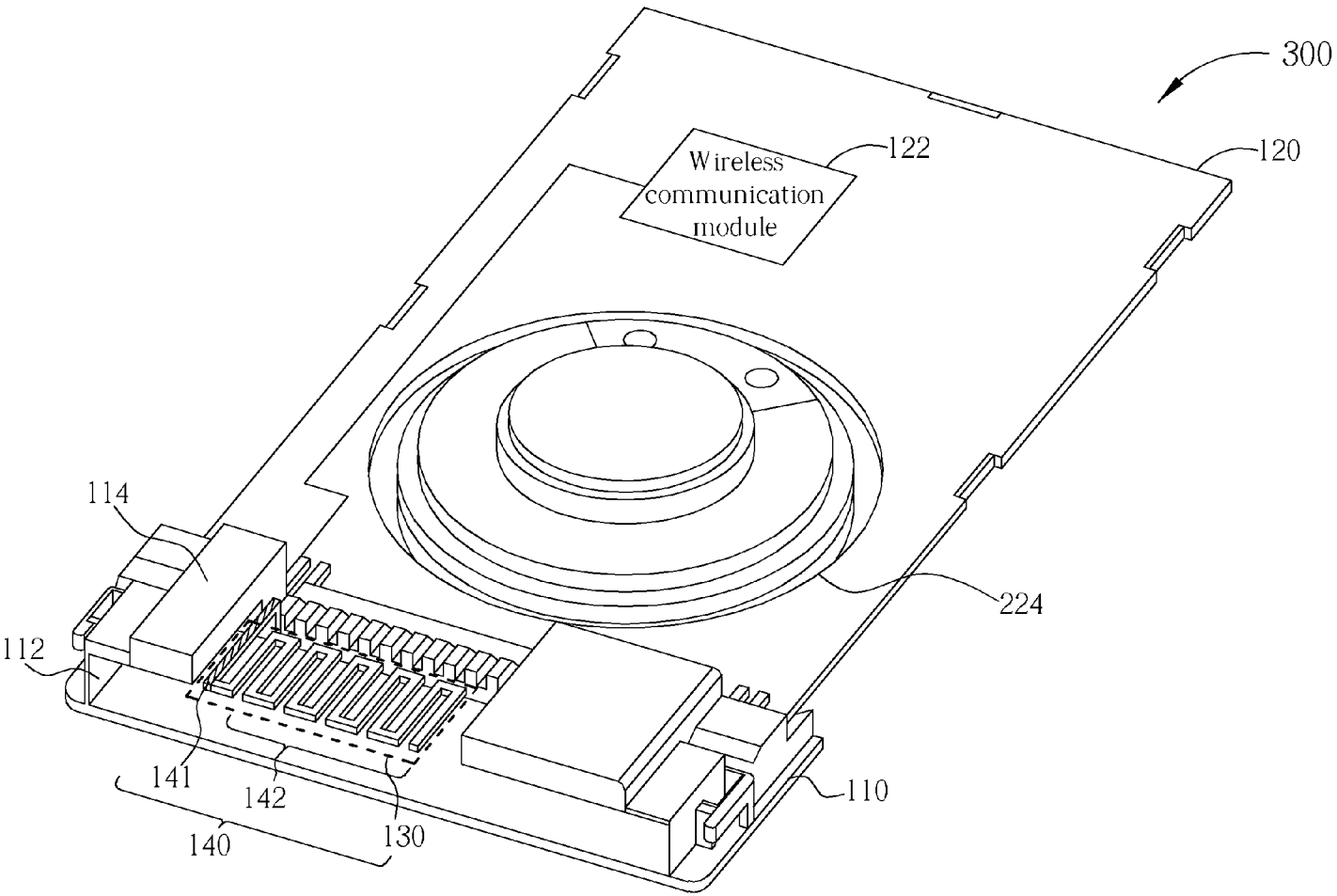
FIG. 3 is a diagram of an example showing a location to dispose the antenna shown in FIG. 1 on the expansion card.

In the following, several embodiments are taken to describe the positions of the antenna 130. Please refer to FIG. 3. FIG. 3 is a diagram of an example showing a location to dispose the antenna 130 shown in FIG. 1 on an expansion card 300. Please note that devices shown in FIG. 3 and the following diagrams that have the same reference numerals as those shown in FIG. 1 also have the same function, and therefore will not be described again. As shown in FIG. 3, the plurality of metal pins 140 of the expansion card 300 includes a plurality of second designated pins 142 and the plurality of second designated pins 142 is electrically connected to each other to be a radiator of the antenna 130. And then the antenna 130 uses the first designated pin 141 of the plurality of metal pins 140 as its feeding point to be electrically connected to the wireless communication module 122 of the circuit board 120. In this embodiment, the first designated pin 141 and the second designated pins 142 are unused pins of the expansion card 300, such as reserved pins or idle pins. Please note that, the antenna 130 can be a monopole antenna, a dipole antenna, a chip antenna, or a planar antenna, but this should not be a limitation of the present invention. Those skilled in the art should know that an antenna structure of other types could be used.

Figure 4:
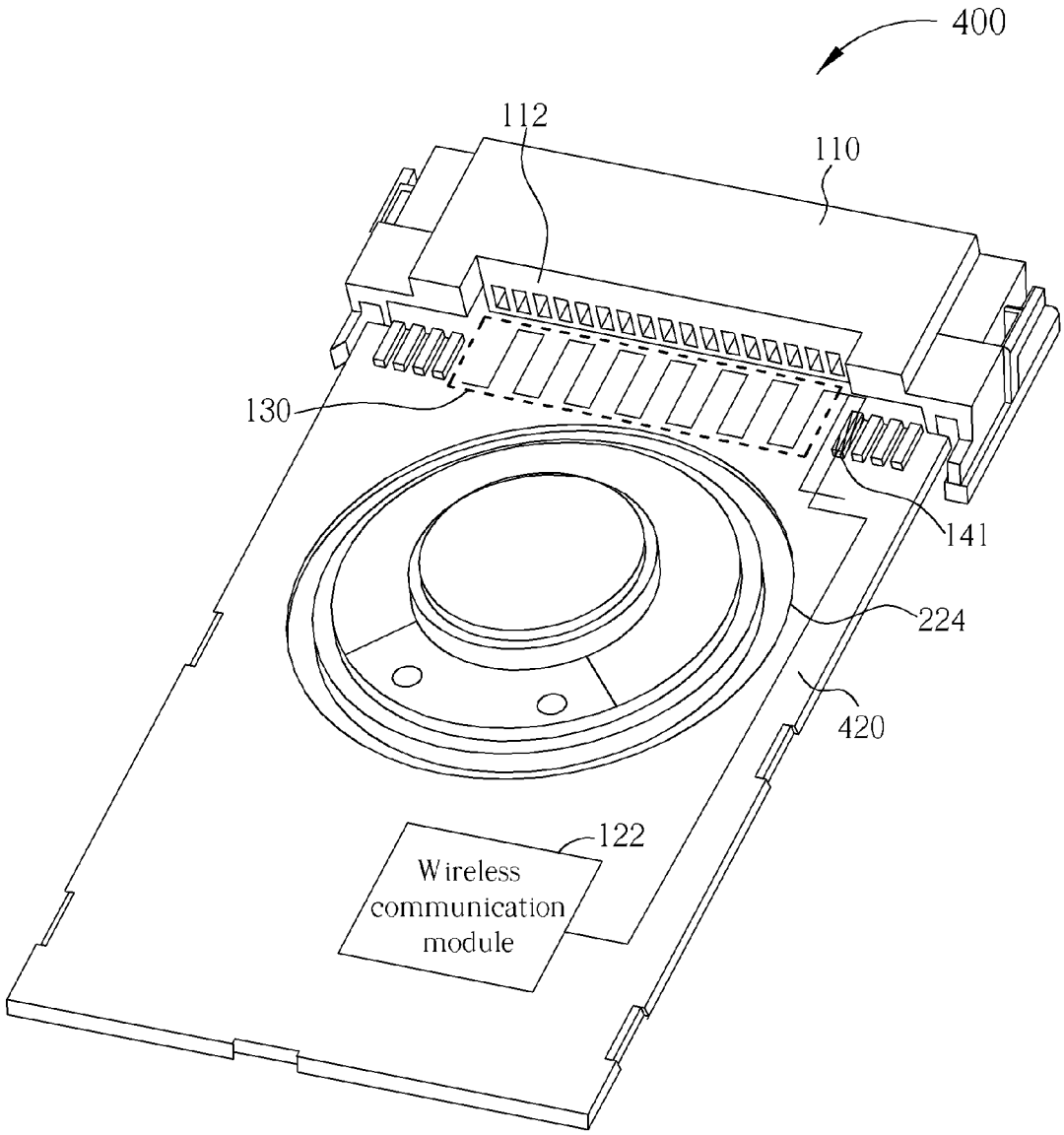
FIG. 4 is a diagram of another example showing a location to dispose the antenna shown in FIG. 1 on the expansion card.
Figure 5:
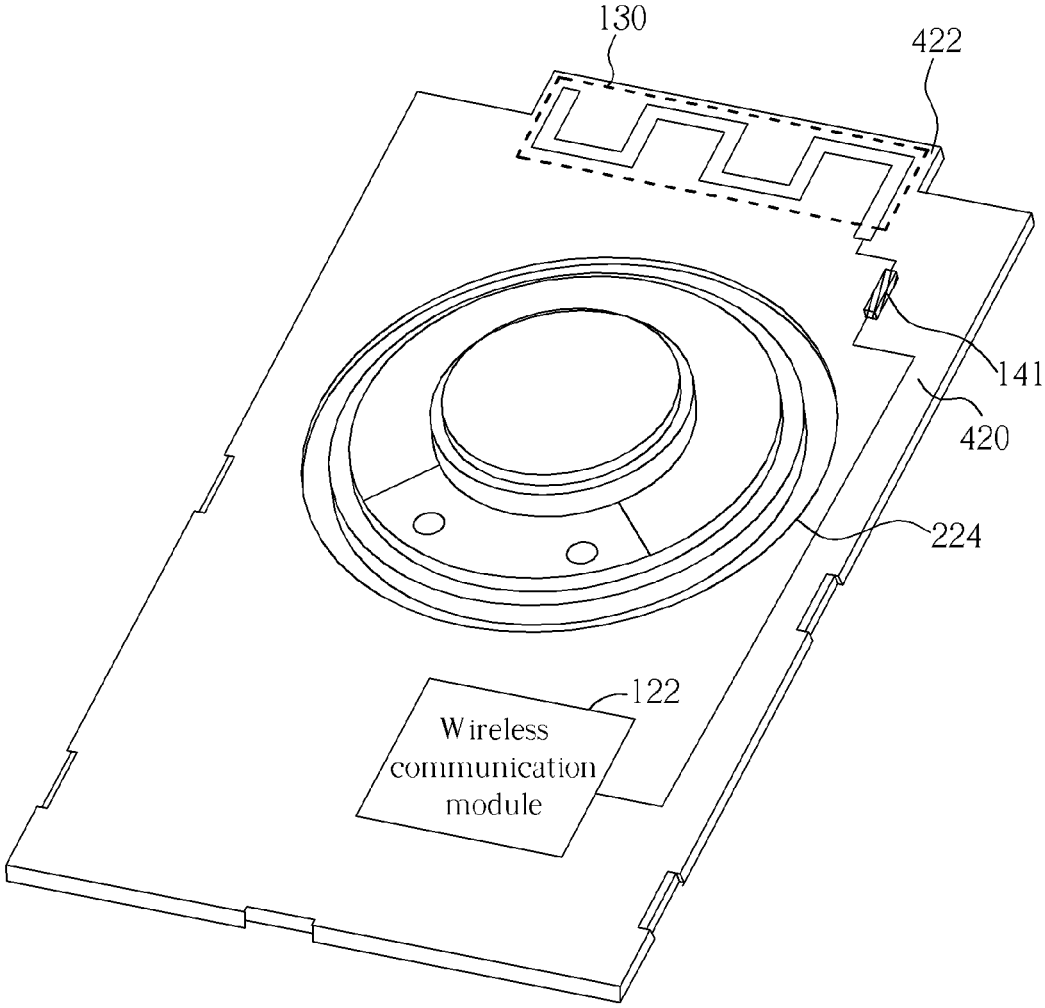
FIG. 5 is a diagram of another example showing a location to dispose the antenna shown in FIG. 1 on the expansion card.

In the abovementioned embodiment, the first designated pin 141 of the expansion card 300 is the feeding point of the antenna 130 and the plurality of second designated pins 142 is used to be the radiator of the antenna 130. The antenna 130 above is merely an exemplary implementation. In other embodiments, different antenna structures and different locations of the antenna can be designed. Please refer to FIG. 4 and FIG. 5. FIG. 4 and FIG. 5 are diagrams of another example showing a location to dispose the antenna 130 shown in FIG. 1 on an expansion card 400. FIG. 4 shows all the elements of the expansion card 400 and FIG. 5 shows the other elements except for the expansion card connector 110. As shown in FIG. 5, a side of a circuit board 420 includes a protruding section 422. Furthermore, at least one part of the radiator of the antenna 130 is disposed on the protruding section 422, and the antenna 130 uses the first designated pin 141 as its feeding point to be electrically connected to the wireless communication module 122 of the circuit board 420. As shown in FIG. 4 and FIG. 1, the expansion card connector 110 includes a containing space 112, and the protruding section 422 of the circuit board 420 is disposed inside the containing space 112. The circuit board 420 is composed of plastic material, and the radiator of the antenna 130 is disposed on the circuit board 420 by layout or in an embedded manner. Because the protruding section 422 is disposed inside the containing space 112 and the expansion card connector 110 and the circuit board 420 are both composed of non-metal plastic materials, such as plastic materials or glass fiber, it won't affect the operations and efficiency of the antenna 130 to dispose it on the protruding section 422.

Figure 6:
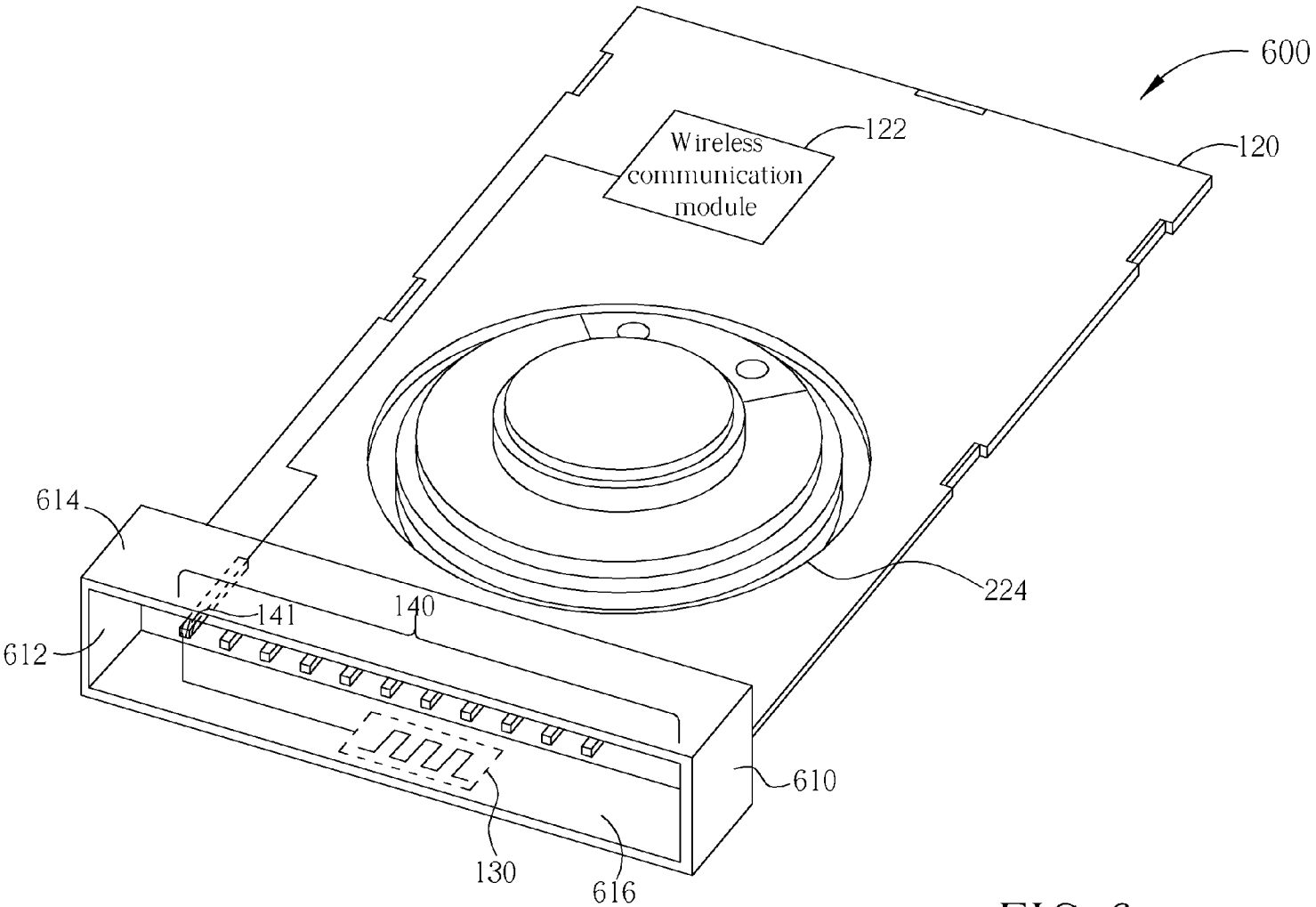
FIG. 6 is a diagram of another example showing a location to dispose the antenna shown in FIG. 1 on the expansion card.

Please refer to FIG. 6. FIG. 6 is a diagram of another example showing a location to dispose the antenna 130 shown in FIG. 1 on an expansion card 600. An expansion card connector 610 has a containing space 612, and the containing space 612 includes a first plane 614 parallel to a second plane 616. The plurality of metal pins 140 is disposed on the first plane 614 in parallel, and the radiator of the antenna 130 is disposed on the second plane 616. For example, the antenna 130 is buried into the inner plastic of the second plane 616, and then the antenna 130 uses the first designated pin 141 to be the feeding point to be electrically connected to the wireless communication module 122 of the circuit board 120. Because the antenna 130 is disposed on the second plane 616 inside the containing space 612, it won't be affected by the metal pins 140 disposed on the first plane 614. In addition, the expansion card connector 610 is composed of plastic materials or other non-metal materials, thus it won't affect the operations and efficiency of the antenna 130 to dispose it on the second plane 616 of the expansion card connector 610.

Figure 7:
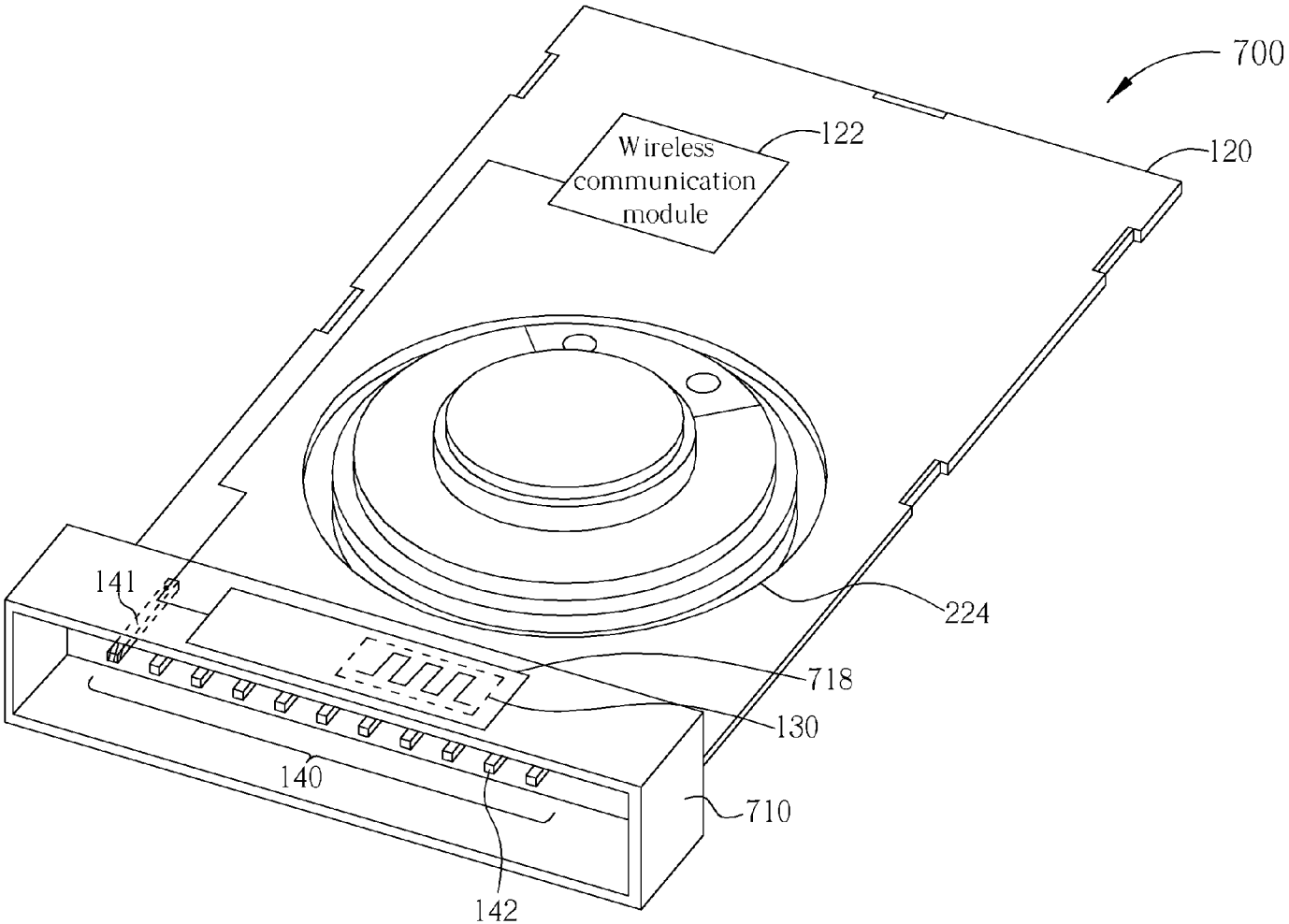
FIG. 7 is a diagram of another example showing a location to dispose the antenna shown in FIG. 1 on the expansion card.

Please refer to FIG. 7. FIG. 7 is a diagram of another example showing a location to dispose the antenna 130 shown in FIG. 1 on an expansion card 700. As shown in FIG. 7, an expansion card connector 710 further includes an idiot-proof device 718 being disposed on a surface of the expansion card connector 710. (The idiot-proof device is a device whereby the expansion card or some structure is not permitted to be inserted or attached in a way that is not intended by the design of the device. Please note that because those skilled in the field already appreciate the architecture, shape, and location of the idiot-proof device 718, a function block is used to simply represent the idiot-proof device 718 in FIG. 7 without affecting the disclosure of the present invention.) The radiator of the antenna 130 is disposed on the idiot-proof device 718. For example, the antenna 130 is buried into the inner plastic of the idiot-proof device 718. In this embodiment, the idiot-proof device 718 is an established component of the expansion card connector 710 and is composed of plastic materials or other non-metal materials; hence, it will neither spend extra money nor affect the operations and efficiency of the antenna 130 to dispose it on the idiot-proof device 718.

The abovementioned embodiments are presented merely for describing the present invention, and in no way should be considered to be limitations of the scope of the present invention. The abovementioned computer apparatus 200 can be a desktop PC or a notebook PC, but is not limited to this only and can be computer apparatuses of other types. The expansion cards 100-700 can be Express cards, PCMCIA cards, or PC cards, but are not limited to this only and can be expansion cards of other types. In the abovementioned embodiments, unused pins such as reserved pins or idle pins, are used to be the feeding point (the first designated pin 141) of the antenna 130. The radiator of the antenna 130 can have various modifications, for example, the plurality of second designated pins 142 can be electrically connected to each other to be the radiator of the antenna 130. Or the radiator of the antenna 130 can be disposed on the protruding section 422 of the circuit board 420, the second plane 616 of the expansion card connector 610, or the idiot-proof device 718 of the expansion card connector 710. Those skilled in the art should appreciate that various modifications of the locations of the radiator of the antenna 130 may be made without departing from the spirit of the present invention. Please note that, the antenna 130 can be a monopole antenna, a dipole antenna, a chip antenna, or a planar antenna, but this should not be a limitation of the present invention. Those skilled in the art know that antenna structures of other types could be used.

In summary, the present invention provides an antenna structure combined application with an expansion card connector and related expansion card and computer apparatus. Through disposing the antenna structure on the expansion card connector and using unused pins of the expansion card connector to be the feeding point of the antenna, not only can the functions of the expansion card be fully utilized but also no extra fees are needed. Because the expansion card connectors 110-710, the circuit board 120-420, and the idiot-proof device 718 are composed of plastic materials or other non-metal materials; hence, it won't affect the operations and efficiency of the antenna 130 to dispose it on the plastic materials. Furthermore, if the antenna is not suitable to be disposed on the circuit board of the expansion card or there is no surplus space to dispose the antenna, it can not only save area but also can fully take advantage of the efficiency of the antenna if the antenna is disposed on the expansion card connector.

Those skilled in the art will readily observe that numerous modifications and alterations of the device and method may be made while retaining the teachings of the invention.

What is claimed is:

1. An antenna structure comprising:

an expansion card connector, comprising a containing space, for coupling to an expansion card to enable connection of the expansion card to a peripheral device;

an antenna, disposed on an inner surface of the containing space of the expansion card connector; and a plurality of metal pins, disposed on an inner surface of the containing space of the expansion card connector, having a first designated pin to be a feeding point of the antenna.

2. The antenna structure of claim 1, wherein the plurality of metal pins further comprises a plurality of second designated pins, and the plurality of second designated pins is electrically connected to each other to be a radiator of the antenna.

3. The antenna structure of claim 1 further comprising a circuit board that couples to the expansion card connector, wherein a side of the circuit board comprises a protruding section, and at least one part of a radiator of the antenna is disposed on the protruding section.

4. The antenna structure of claim 3, wherein the protruding section of the circuit board is installed inside the containing space, and the circuit board and the expansion card connector form the expansion card.

5. The antenna structure of claim 1, wherein the containing space has a first plane parallel to a second plane, the plurality of metal pins is disposed on the first plane in parallel, and a radiator of the antenna is disposed on the second plane.

6. The antenna structure of claim 1, wherein the expansion card connector further comprises an idiot-proof device being disposed on an inner surface of the expansion card connector, and a radiator of the antenna is disposed on the idiot-proof device.

7. An expansion card comprising:

an expansion card connector, comprising a containing space;

a circuit board;

an antenna, disposed on an inner surface of the containing space of the expansion card connector and electrically connected to the circuit board; and a plurality of metal pins, disposed on an inner surface of the containing space of the expansion card connector, having a first designated pin to be a feeding point of the antenna.

8. The expansion card of claim 7, wherein the plurality of metal pins further comprises a plurality of second designated pins, and the plurality of second designated pins is electrically connected to each other to be a radiator of the antenna.

9. The expansion card of claim 7, wherein a side of the circuit board comprises a protruding section, and at least one part of a radiator of the antenna is disposed on the protruding section.

10. The expansion card of claim 9, wherein the protruding section of the circuit board is installed inside the containing space.

11. The expansion card of claim 7, wherein the containing space has a first plane parallel to a second plane, the plurality of metal pins is disposed on the first plane in parallel, and a radiator of the antenna is disposed on the second plane.

12. The expansion card of claim 7, wherein the expansion card connector further comprises an idiot-proof device being disposed on an inner surface of the expansion card connector, and a radiator of the antenna is disposed on the idiot-proof device.

13. The expansion card of claim 7, wherein the expansion card is an Express card, a PCMCIA card, or a PC card.

14. The expansion card of claim 7 further comprising a loudspeaker or a microphone.

15. A computer apparatus comprising:

an expansion card slot; and an expansion card comprising:

an expansion card connector, comprising a containing space, utilized for connecting to the expansion card slot in a plug-and-play manner;

a circuit board;

an antenna, disposed on an inner surface of the expansion card connector containing space and electrically connected to the circuit board; and a plurality of metal pins, disposed on the inner surface of the expansion card connector containing space, having a first designated pin to be a feeding point of the antenna.

16. The computer apparatus of claim 15, wherein the plurality of metal pins further comprises a plurality of second designated pins, and the plurality of second designated pins is electrically connected to each other to be a radiator of the antenna.

17. The computer apparatus of claim 15, wherein the expansion card is an Express card, a PCMCIA card, or a PC card.

18. The computer apparatus of claim 15, wherein the computer apparatus is a notebook computer.

* * * * *